US007971512B2

(12) United States Patent
Tanaka

(10) Patent No.: US 7,971,512 B2
(45) Date of Patent: Jul. 5, 2011

(54) CUTTING DEVICES

(75) Inventor: Koji Tanaka, Anjo (JP)

(73) Assignee: Makita Corporation, Anjo-shi (JP)

( * ) Notice: Subject to any disclaimer, the term of this patent is extended or adjusted under 35 U.S.C. 154(b) by 522 days.

(21) Appl. No.: 12/073,959

(22) Filed: Mar. 12, 2008

(65) Prior Publication Data

US 2008/0223189 A1 Sep. 18, 2008

(30) Foreign Application Priority Data

Mar. 15, 2007 (JP) ..... 2007-066712

(51) Int. Cl.
*B27G 19/00* (2006.01)

(52) U.S. Cl. ..... 83/477.2; 83/478; 83/440.2; 144/251.1

(58) Field of Classification Search ..... 83/478, 83/477.2, 440.2, 860, 481; 144/251.1
See application file for complete search history.

(56) References Cited

U.S. PATENT DOCUMENTS

| | | | | |
|---|---|---|---|---|
| 2,352,235 | A * | 6/1944 | Tautz | 83/102.1 |
| 6,405,624 | B2 | 6/2002 | Sutton | |
| 7,437,981 | B2 * | 10/2008 | Burke et al. | 83/102.1 |
| 7,600,456 | B2 * | 10/2009 | Burke et al. | 83/102.1 |
| 7,631,585 | B2 * | 12/2009 | Ichikawa et al. | 83/102.1 |
| 7,665,393 | B2 * | 2/2010 | O'Banion et al. | 83/102.1 |
| 2006/0042441 | A1 * | 3/2006 | Ichikawa et al. | 83/102.1 |
| 2007/0056416 | A1 * | 3/2007 | Shibata | 83/440.2 |
| 2008/0047409 | A1 * | 2/2008 | Chuang | 83/102.1 |
| 2009/0056514 | A1 * | 3/2009 | Chen | 83/102.1 |
| 2010/0116114 | A1 * | 5/2010 | Liu et al. | 83/478 |

FOREIGN PATENT DOCUMENTS

| | | |
|---|---|---|
| EP | 1 491 304 A2 | 12/2004 |
| JP | U-06-046901 | 6/1994 |
| JP | A-2006-068940 | 3/2006 |

* cited by examiner

*Primary Examiner* — Boyer D Ashley
*Assistant Examiner* — Omar Flores-Sánchez
(74) *Attorney, Agent, or Firm* — Oliff & Berridge, PLC

(57) ABSTRACT

A cutting device includes a lock device for locking and unlocking a cover against a cover support. The cover includes a first cover removably mounted to the cover support and a second cover removably mounted to the first cover. The lock device is operable in a first mode, a second mode and a third mode. The first mode prevents the first cover from being removed from the cover support and prevents the second cover from being removed from the first cover. The second mode permits the first cover from being removed from the cover support but prevents the second cover from being removed from the first cover. The third mode permits the second cover to be removed from the first cover.

14 Claims, 6 Drawing Sheets

CUTTING DEVICES

This application claims priority to Japanese patent application serial number 2007-066712, the contents of which are incorporated herein by reference.

BACKGROUND OF THE INVENTION

1. Field of the Invention

The present invention relates to cutting devices, and in particular to cutting devices called "table saws" that have a table for placing a workpiece thereon and have a saw blade partly extending upward from the upper surface of the table for cutting the workpiece.

2. Description of the Related Art

Table saws are known that have a table for placing a workpiece thereon and have a circular saw blade partly extending upward from the upper surface of the table, so that the workpiece can be cut as the workpiece is moved toward the saw blade along the upper surface of the table. In some known table saws, side covers are disposed on the upper surface of the table on laterally opposite sides of the upwardly protruding part of the circular saw in order to prevent the saw blade from being interfered with other parts or devices or to prevent cutting chips from scattering. The side covers are vertically pivotable, so that the side covers can be lifted by the workpiece as the workpiece moves toward the saw blade in a cutting direction. In general, the side covers are vertically pivotally supported on a splitter (also called "riving knife") that is positioned rearward of the saw blade in alignment therewith in the cutting direction. The splitter serves to prevent a phenomenon known as a kickback phenomenon of a workpiece. However, there is a possibility that the side covers hinder the replacement work of the saw blade, because the side covers are disposed on the laterally opposite sides of the saw blade. Therefore, during such a replacing operation, the side covers are held in an upward position or are removed from the splitter. Table saws of this type are disclosed, for example, in Japanese Laid-Open Patent Publication No. 2006-68940, Japanese Laid-Open Utility Model Publication No. 6-46901, U.S. Pat. No. 6,405,624 and European Patent No. 1491304.

However, simply holding the side covers in the upward position by pivoting the side covers upward away from the lateral sides of the saw blade may still have a possibility of causing interference with the replacement work. For example, it may still be difficult to operate hand tools, such as spanners, even if the side covers are held in the upward position. As a result, the replacement of the saw blade has still required a troublesome operation.

On the other hand, a troublesome operation is required for removing the side covers from the splitter. Thus, for removing the side covers, an operation is require that is nearly to the operation for completely disassembling the side covers, including the operation for removing a support shaft that pivotally supports the side covers on the splitter. Therefore, the replacement work of the saw blade cannot be quickly performed.

Therefore, there has been a need for cutting devices that enable side covers to be quickly removed.

SUMMARY OF THE INVENTION

One aspect according to the present invention includes a cutting device that includes a table, a saw blade, a cover support and a cover. The cover support may be a splitter. The cover includes a first cover and a second cover for covering the saw blade from different sides from each other. The first cover is removably mounted to the cover support. The second cover is removably mounted to the first cover. A lock device is operable in a first mode, a second mode and a third mode. The first mode prevents the first cover from being removed from the cover support and prevents the second cover from being removed from the first cover The second mode permits the first cover from being removed from the cover support but prevents the second cover from being removed from the first cover. The third mode permits the second cover to be removed from the first cover. In the third mode, the first cover may be permitted to be removed from the cover support or may be prevented from being removed from the cover support.

DETAILED DESCRIPTION OF THE INVENTION

Figure 1:
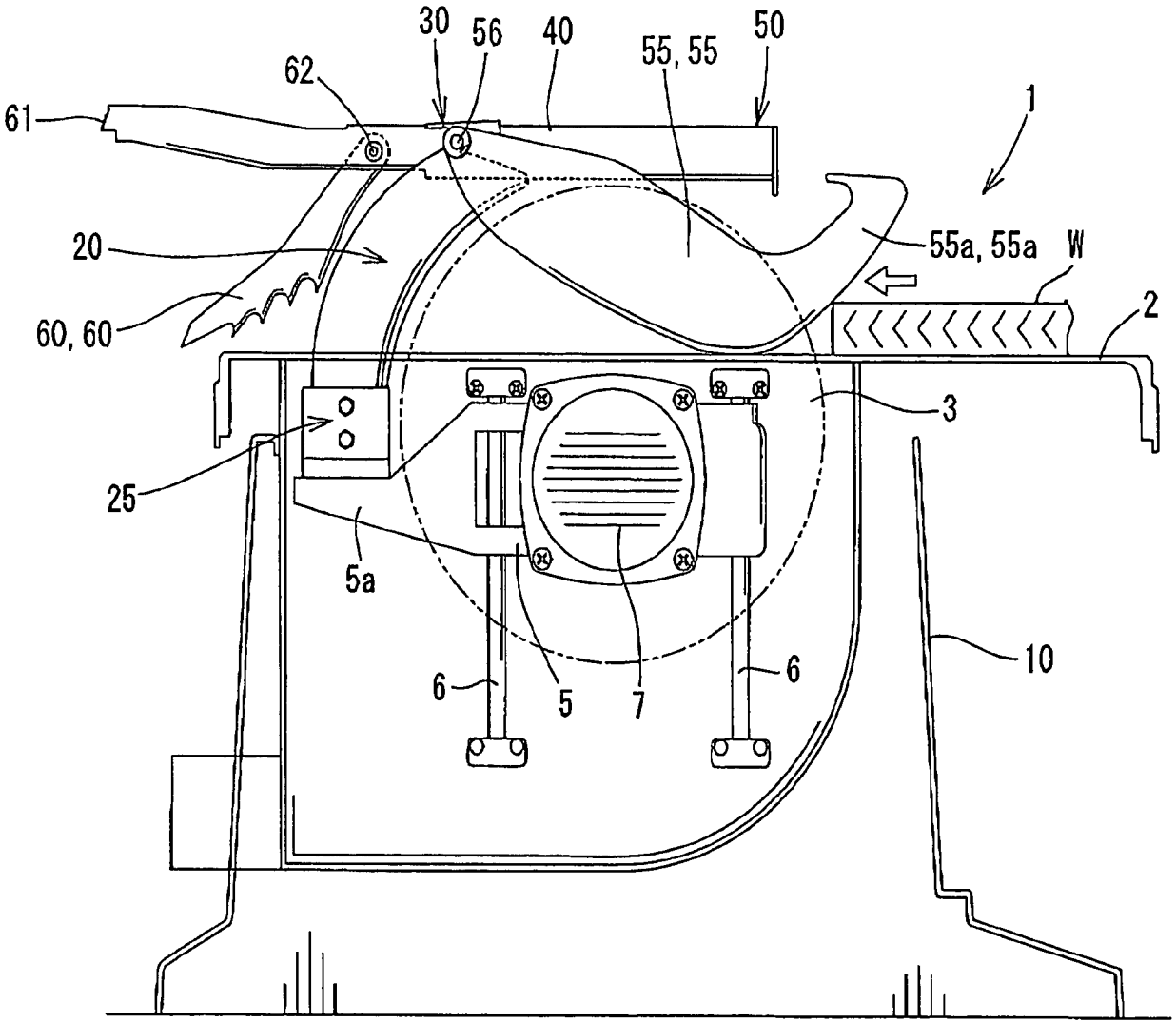
FIG. 1 is a front view of a table saw according to an embodiment of the present invention.

Each of the additional features and teachings disclosed above and below may be utilized separately or in conjunction with other features and teachings to provide improved cutting devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a cutting device includes a table having an upper surface for placing a workpiece thereon, a saw blade protruding from the upper surface of the table, a splitter disposed on a front side with respect to a cutting direction of the saw blade and positioned in alignment with the saw blade, and a cover device for covering the saw blade. The cover device includes a top cover for covering an upper side of the saw blade, a pair of side covers for covering laterally opposite sides of the saw blade, and a mount device for mounting the top cover to the splitter and for mounting the side covers to the top cover. The mount device includes an operation lever pivotally supported on the top cover and having at least three operational positions including a first operational position, a second operational position and a third operational position. The top cover and the side covers can be mounted to the splitter when the operation lever is operated to move to the first operational position. The top cover and the side covers can be removed together from the splitter when the operation lever is operated to move to the second operational position. The side covers can be removed from the top cover when the operation lever is operated to move to the third operational position.

Therefore, when the operation lever is pivoted to the first operational position with the side covers set to the top cover and with the top cover set to the splitter, the top cover can be fixed in position relative to the splitter and the side covers can be fixed in position relative to the top cover. As a result, both of the top cover and the side covers can be fixed in position relative to the splitter.

When the operation lever is pivoted to the third operational position, the side covers can be removed from the top cover. Therefore, it is possible to remove only the side covers from the splitter. Alternatively, the top cover and the side covers can be removed independently of each other. By removing the side covers, it is possible to position the side covers further away from the saw blade, so that the work for replacement of the saw blade can be rapidly performed.

When the operation lever is pivoted to the second operational position, the top cover and the side covers can be removed together from the splitter. By removing the top cover and the side covers, there would be no obstacle on the upper side and also on the lateral side of the saw blade. Therefore, the replacement work of the saw blade can be further rapidly performed. In addition, it is possible to rapidly prepare for a groove forming operation.

In this way, by positioning the operation lever to either one of the first to third operational positions, it is possible to achieve the state where the top cover and the side covers have been mounted to the splitter, for example, for performing a cutting operation, the state where the side covers have been removed, or the state where the top cover and the side covers have been removed from the splitter. Therefore, it is possible to easily mount or remove the side covers according to the mode of use of the cutting device or according to the necessary operation, such as an operation for replacement of the saw blade. Hence, the replacement work of the saw blade can be rapidly performed.

The mount device may include a first shaft, a second shaft, a third shaft, a first engaging device and a second engaging device. The first shaft vertically pivotally supports the operation lever relative to the top cover. The second shaft vertically pivotally supports one end of an actuation arm relative to the operation lever. The third shaft is supported on the other end of the actuation arm, so that the third shaft can move to a first position, a second position and a third position as the operation lever pivots about the first shaft to the first operational position, the second operational position and the third operational position, respectively. The first position is the furthest from the first shaft. The second position is positioned between the first position and the third position. When the operation lever is in the first operational position, the third shaft is positioned at the first position, so that the top cover can be fixed in position relative to the splitter, and the side covers can be prevented from being removed from the top cover by the first engaging device. When the operation lever is in the second operational position, the third shaft is positioned at the second position, so that the top cover can be removed from the splitter, and the side covers can be prevented from being removed from the top cover by the second engaging device. When the operation lever is in the third operational position, the third shaft is positioned at the third position, so that the side covers can be removed from the top cover.

With this arrangement, as the operation lever pivots to the first operational position, the third shaft moves to the first position. Then, the distance between the first shaft and the third shaft becomes maximum, so that the top cover can be fixed in position relative to the splitter. In addition, in this state, the side covers are prevented from being removed from the top cover by the first engaging device. Therefore, by pivoting the operation lever to the first operational position, the top cover and the side covers can be held in the mounted position to the splitter.

As the operation lever pivots to the second operational position, the third shaft moves to the second position. Then, the distance between the first shaft and the third shaft decreases, so that the top cover can be removed from the splitter. In addition, in this state, the side covers can be prevented from being removed from the top cover by the second engaging device. Therefore, by pivoting the operation lever to the second operational position, the top cover and the side covers can be removed together from the splitter.

As the operation lever pivots to the third operational position, the third shaft moves to the third position. Then, the distance between the first shaft and the third shaft becomes minimum, so that the top cover can be removed from the splitter. In addition, in this state, the side covers can be removed from the top cover. It is possible to configure such that the top cover and the side covers can be removed from the splitter in the state where the top cover is separated from the side covers or such that the top cover can be held to be mounted to the splitter and only the side covers can be removed from the top cover.

The splitter may have an opening and a mount slot formed in continuity with the opening. The opening is formed in a cut-in manner in an upper portion of the splitter and has a first width. The mount slot has an elongated configuration and has a second width larger than the first width of the opening. When the operation lever is in the first operational position, the first shaft and the third shaft can engage opposite edges in forward and rearward directions of the mount slot, so that the first shaft and the third shaft can be prevented from moving though the opening to thereby enable to mount the top cover to the splitter. When the operation lever is in the second operational position, the first and the third shaft can move through the opening to thereby enable to remove the top cover from the splitter.

With this arrangement, as the operation lever pivots, the distance between the first shaft and the third shaft changes due to the movement of the third shaft. More specifically, as the operation lever pivots to the first operational position, the distance between the first shaft and the third shaft becomes maximum. Therefore, by pivoting the operation lever to the first operational position with the top cover set to the splitter, the first shaft and the third shaft engage the forward edge and the rearward edge of the mount slot of the splitter, respectively, and therefore, they cannot move through the opening. As a result, the top cover can be fixed in position relative to the splitter.

On the other hand, as the operation lever pivots to the second operational position, the distance between the first shaft and the third shaft is reduced. Therefore, the engagement of the first shaft with the forward edge of the mount slot and the engagement of the third shaft with the rearward edge of the mount slot can be released. Hence, the first shaft and the third shaft can move through the opening. As a result, the top cover can be removed from the splitter.

An embodiment of the present invention will now be described with reference to FIGS. 1 to 7. FIG. 1 generally shows a table saw 1 as an example of a cutting device. The reference numeral 2 designates a table on which a workpiece W is to be placed. The table 2 is supported on a machine base 10, so that the upper surface of the table 2 extends substantially in a horizontal direction. A circular saw blade 3 is positioned substantially centrally of the table 2 and extends vertically through the table 2. The upper portion of the saw blade 3 extends upward from the upper surface of the table 2. The saw blade 3 is supported on a vertically movable base 5 that is disposed below the table 2. An electric motor 7 rotatably drives the saw blade 3. The movable base 5 is slidably movably supported by a pair of vertical slide shafts 6, so that the movable base 5 can translate along the slide shafts 6. Changing the vertical position of the movable base 5 can change a protruding distance of the saw blade 3 from the upper surface of the table 2, so that a cutting depth of the saw blade 3 into the workpiece W can be adjusted.

The workpiece W can be cut by moving the workpiece W relative to the saw blade 3 in a direction indicated by an outline arrow in FIG. 1. This direction will be hereinafter called "cutting direction." A splitter (also called "a riving knife") 20 is positioned on the front side with respect to the cutting direction (left side as viewed in FIG. 1) of the saw blade 3.

The splitter 20 is formed of a flat plate having a thickness substantially equal to the thickness of the saw blade 3. The splitter 20 is positioned in alignment with the saw blade 3. The splitter 20 is mounted to a base portion 5*a* of the movable base 5 via a mount base 25, so that an upper portion of the splitter 20 extends vertically through the table 2 and protrudes upward from the upper surface of the table 2. The splitter 20 serves to enter the kerf of the workpiece W, which is formed in the workpiece W immediately after being cut by the saw blade 3. Therefore, the width of the kerf can be maintained for preventing potential interference of the kerf with the saw blade 3 and for eventually preventing a kickback phenomenon of the workpiece W.

A cover device 50 is mounted to the upper end of the splitter 20. The cover device 50 includes a top cover 40, a pair of side covers 55 and a lock device or a mount device 30. The top cover 40 is adapted to cover the saw blade 3 primarily from the upper side. The side covers 55 are adapted to cover the upwardly protruding portion of the saw blade 3 from laterally opposite sides. The mount device 30 is operable to mount these covers 40 and 55 to the splitter 20.

Figure 2:
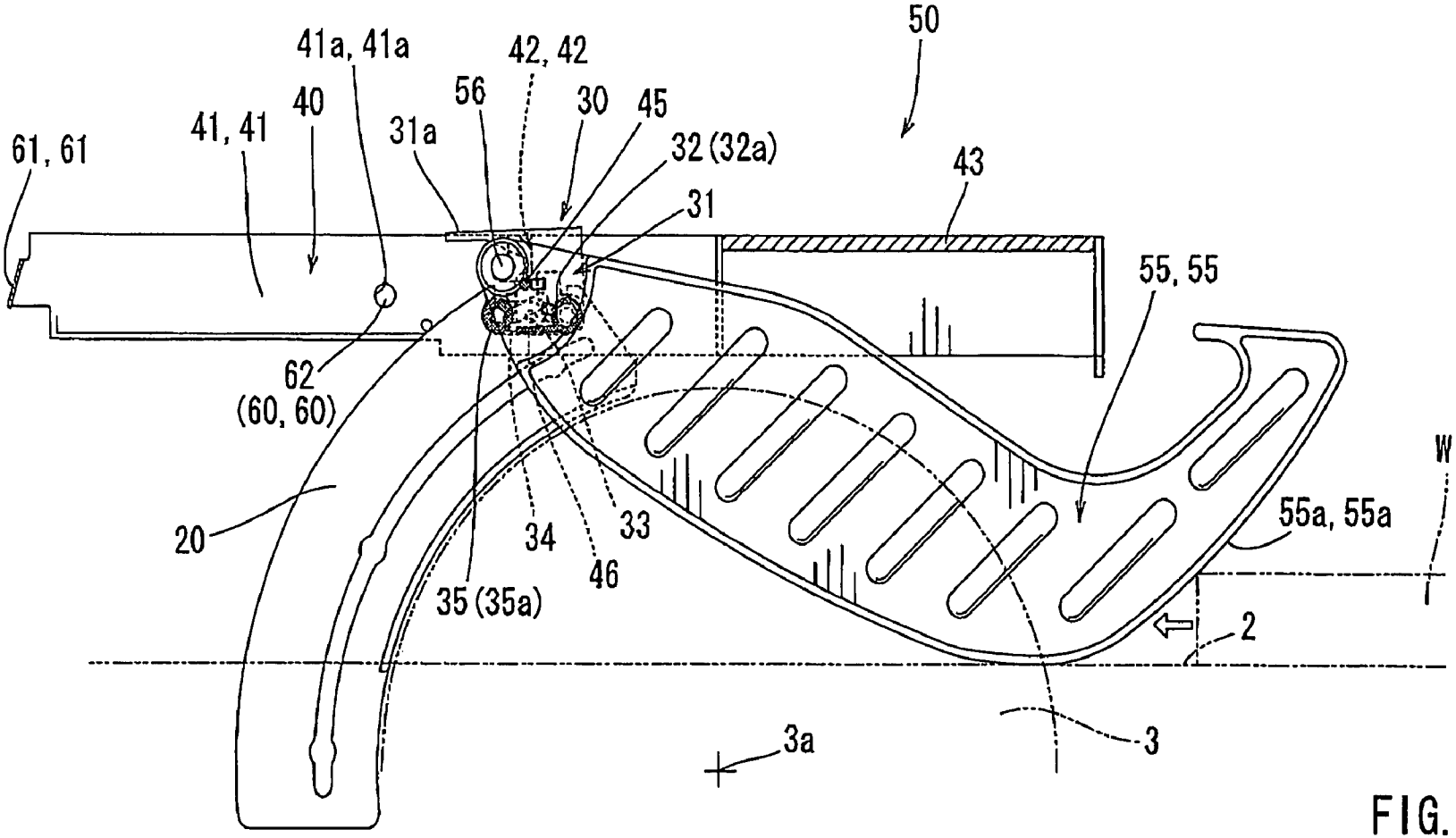
FIG. 2 is a front view of a cover device of the table saw.

As shown in FIG. 2, the top cover 40 extends forwardly and rearwardly from the upper end of the splitter 20. The top cover 40 includes a pair of lateral side portions 41 and a top portion 43. The top portion 43 extends between the upper edges of the lateral side portions 41 along a length corresponding to a region above the saw blade 3. On the front side of the top portion 43 and at substantially the central position with respect to the longitudinal direction of the laterally side portions 41, the side covers 55 are supported between the laterally side portions 41 and the mount device 30 is assembled between the laterally side portions 41. In FIG. 2, the reference numeral 3*a* designates a rotational axis of the saw blade 3.

A pair of support holes 41*a* are formed in a front portion of the top cover 40, which is positioned on the front side (left side as viewed in FIG. 2) of the splitter 20. A pair of kickback preventing claws 60 are vertically pivotally supported on a support shaft 62 that extends between the support holes 41*a*. The kickback preventing claws 60 serve to prevent the workpiece W from being forced upward by the rotating saw blade 3 immediately after the work piece W has been cut. Although the kickback preventing claws 60 are shown in FIG. 1, these claws are not shown in FIG. 2 for the purpose of illustration. Springs (not shown) bias the kickback preventing claws 60, respectively, in a downward direction (counterclockwise direction as viewed in FIG. 1).

A retainer 61 is disposed at the front end (with respect to the cutting direction) of the top cover 40 and serves to engage and hold the kickback preventing claws 60 at a rest position, where each kickback preventing claw 60 extends along the corresponding lateral side portion 41 of the top cover 40. The kickback preventing claws 60 can be held by the retainer 61 by pivoting the kickback preventing claws 60 upward against the springs and thereafter positioning (engaging) them on retainer 61.

Each of the side covers 55 has a flat plate-like configuration and is made of translucent resin material. The side covers 55 have configurations symmetrical with each other and have front ends with respect to the cutting direction, which are vertically pivotally supported on the top cover 40 via a cover shaft 56. The side covers 55 can cover the laterally opposite sides mainly of the cutting edge of the upwardly protruding part of the saw blade 20. The rear portion with respect to the cutting direction (right side portions as viewed in FIG. 2) of each side cover 55 has a guide portion 55*a* that is bent to extend upward along a substantially arc-shaped path. As the workpiece W is moved in the cutting direction as indicated by the outline arrow in FIG. 2, the front end of the workpiece W contacts the guide portions 55*a* of the side covers 55 and then forces the side covers 55 to pivot upward, so that the side covers 55 are opened.

The side covers 55 can be removed from the top cover 40. To this end, support slots 42 are formed in the lateral side portions 41 of the top cover 40, respectively. The support slots 42 have such a width that allows the cover shaft 56 to be inserted into the support slots 42. The support slots 42 are configured to be symmetrical with each other and each has a vertical portion 42*a* and a horizontal portion 42*b* that jointly form a substantially L-shape configuration. The cover shaft 56 extends through and between the support slots 42 so as to be supported by the top cover 40, so that the top cover 40 vertically pivotally supports the side covers 55 via the cover shaft 56. The cover shaft 56 can be removed from between the side wall portions 41 by moving the cover shaft 56 to translate in the direction vertically upward from the horizontal portion 42*b* along the vertical portion 42*a*. Hence, it is possible to remove the side covers 55 from the top cover 40. However, the removal of the side covers 55 from the top cover 40 is permitted only under a predetermined condition as will be explained later.

Figure 3:
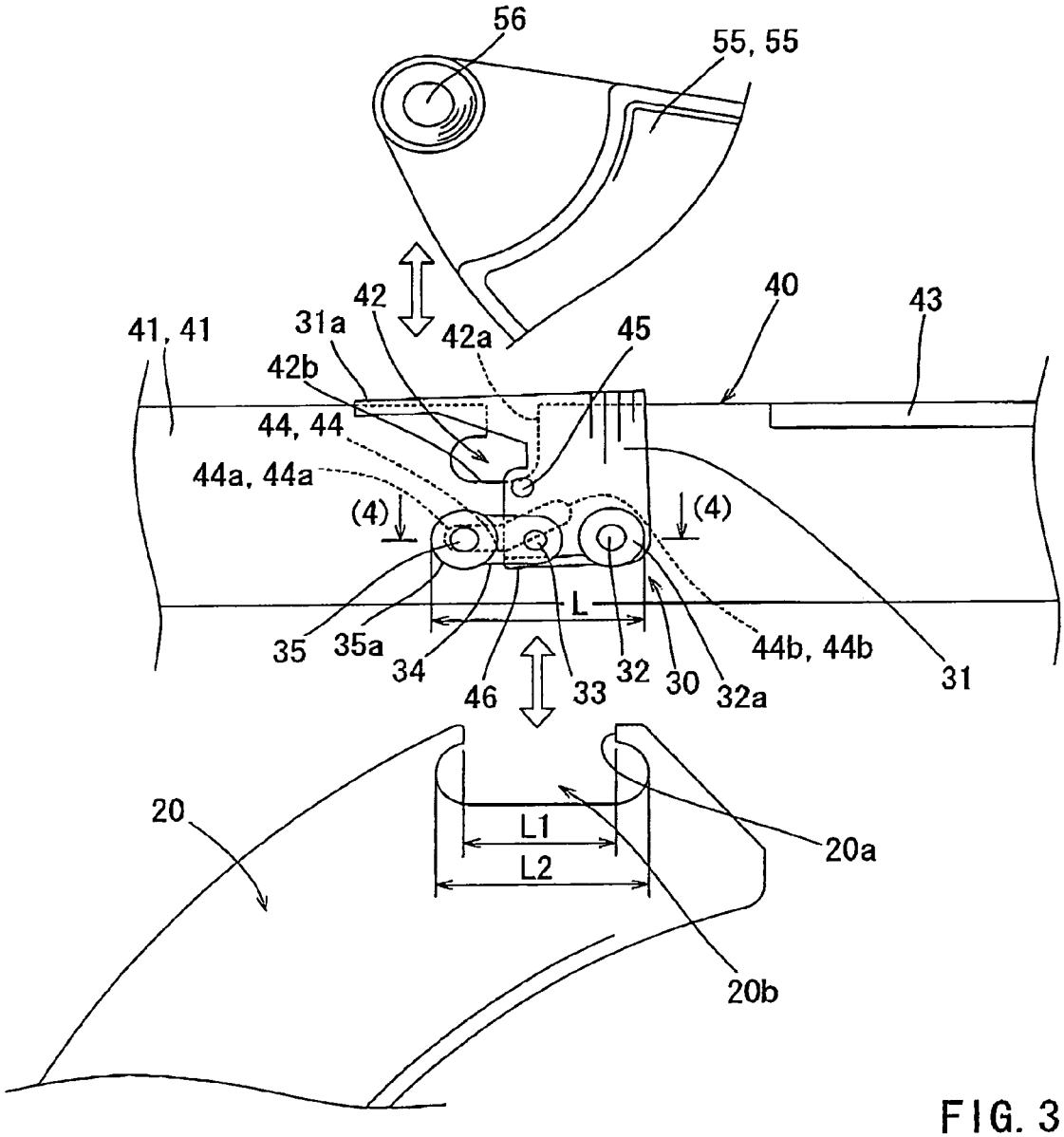
FIG. 3 is a front view of a mount device and its related parts of the table saw and showing a top cover and side covers being removed from a splitter.
Figure 4:
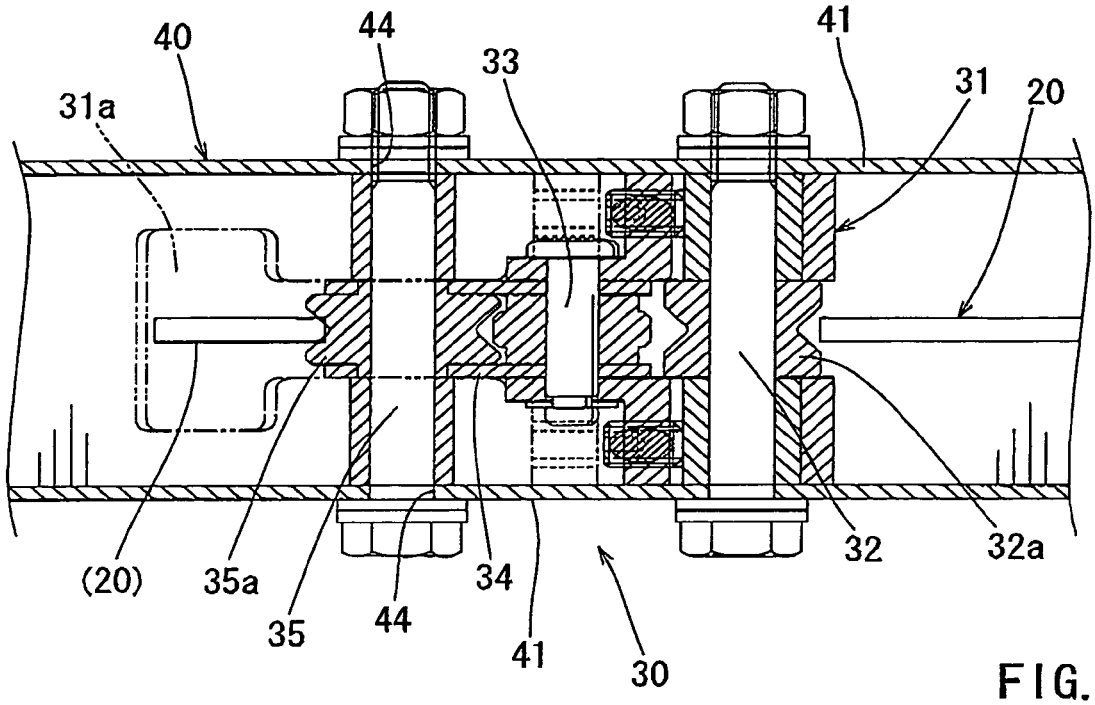
FIG. 4 is a cross sectional view taken along line (4)-(4) in FIG. 3.

The mount device 30 is shown in detail in FIG. 3. The mount device 30 includes an operation lever 31. A first lever shaft 32 vertically pivotally supports the operation lever 31 in a position between the side wall portions 41 of the top cover 40. A first engaging roller 32*a* is supported on the first lever shaft 32.

Figure 5:
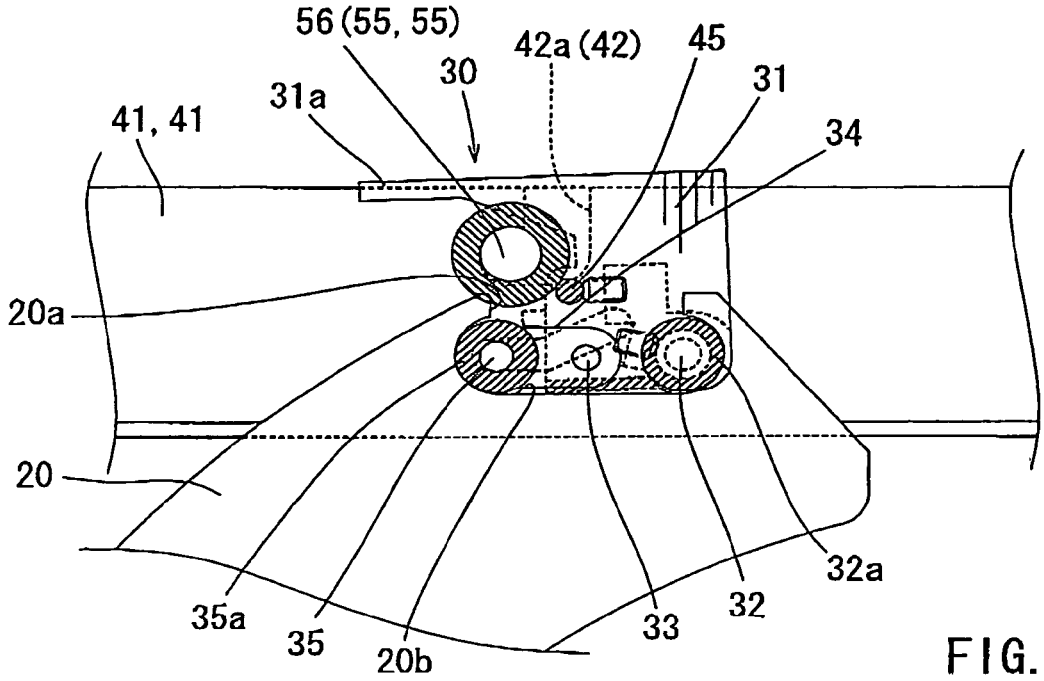
FIG. 5 is a front view of the mount device and showing an operation lever positioned at a first operational position.
Figure 6:
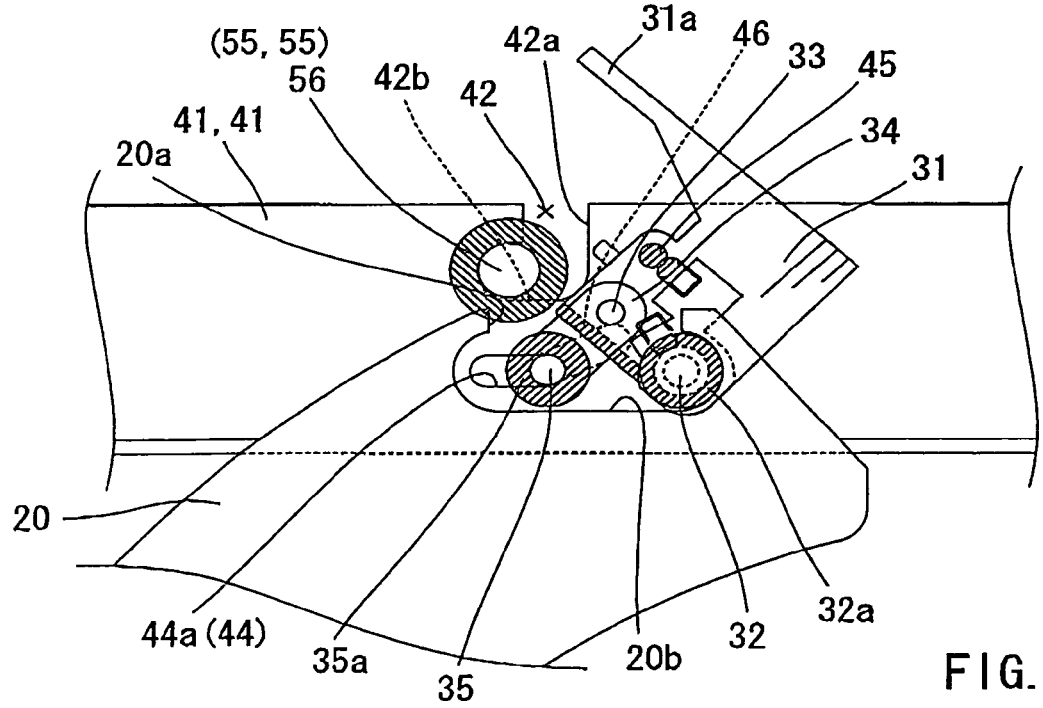
FIG. 6 is a front view similar to FIG. 5 but showing the operation lever positioned at a second operational position.
Figure 7:
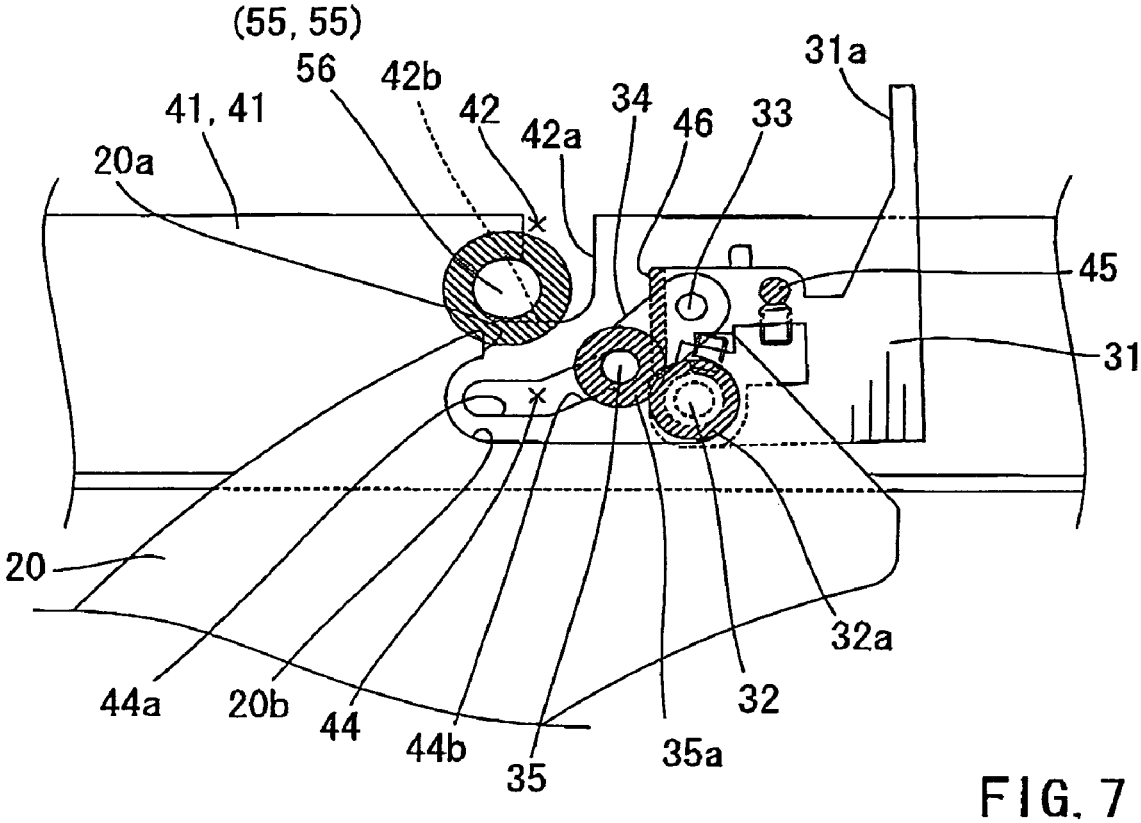
FIG. 7 is a front view similar to FIG. 5 but showing the operation lever positioned at a third operational position.

A knob 31*a* is formed on the operation lever 31 and is adapted to be operated by the operator. The operation lever 31 can take three different operational positions, i.e., a first operational position shown in FIGS. 3 and 5, a second operational position shown in FIG. 6, and a third operational position shown in FIG. 7. As shown in FIGS. 3 and 5, the knob 31*a* extends in substantially parallel to the top portion 43 when the operation lever 31 is in the first operational position. The operation lever 31 can be moved from the first operational position to the second operational position as shown in FIG. 6 as the operator pulls the knob 31*a* in order to pivot the operation lever 31 by an angle of about 45° in the clockwise direction. The operation lever 31 can be moved from the second operational position to the third operational position as shown in FIG. 7 as the operator pivots the operation lever 31 further by an angle of about 45° in the clockwise direction. In other words, as the operator pivots the operation lever 31 from the first operational position by an angle of about 90° in the clockwise direction, the operation lever 31 can move from the first operational position to the third operational position. The modes of operations performed in the first to the operational positions will be explained later. In FIG. 3, for the purpose of illustration, the mount device 30 is shown in the state where the operation lever 31 is in the first position the top cover 40 and the side covers 55 have been removed from the splitter 20. As will be explained later, the top cover 40 can be mounted to and removed from the splitter 20 when the operation lever 31 is in the second or third operational position. The side covers 55 can be mounted and removed from the top cover 40 only when the operation lever 31 is in the third operational position.

A second lever shaft 33 is mounted to the lower portion of the operation lever 31. An actuation arm 34 has one end pivotally supported by the second lever shaft 33. A third lever shaft 35 is mounted to the other end of the actuation arm 34. Opposite ends of the third lever shaft 35 are inserted into corresponding guide slots 44, which are formed in the lateral side portions 41 of the top cover 40. The guide slots 44 and have configurations symmetrical with each other. Each of the guide slots 44 has a horizontal portion 44*a* and a slant portion 44*b*. The horizontal portion 44*a* extends substantially in the cutting direction. The slant portion 44*b* extends from the rear end of the horizontal portion 44*a* and is inclined obliquely relative to the horizontal portion 44*a* by an angle of about 45°. Therefore, the third lever shaft 35 can make only parallel translation movement along the guide slots 44. A third engaging roller 35*a* is supported on the central portion with respect to the axial direction of the third lever shaft 35.

With this arrangement, as the operation lever 31 vertically pivots between the first operational position and the third operational position, the second lever shaft 33 revolves around the first lever shaft 32. In other words, the pivotal support center (i.e., the second lever shaft 33) of the actuation arm 34 moves along a circular path. With this movement of the second lever shaft 33, the actuation arm 34 pivots vertically relative to the second lever shaft 33, while the third lever shaft 35 moves to make parallel translation along the guide slots 44.

When the operation lever 31 is in the first operational position shown in FIGS. 3 and 5, the third lever shaft 35 is positioned between the front ends of the guide slots 44 (more specifically, between the front ends of the horizontal portions 44*a* of the guide slots 44). This position of the third lever shaft 35 will be hereinafter called "first shift position." When the operation lever 31 is in the second operational position shown in FIG. 6, the third lever shaft 35 is positioned substantially at the boundary between the horizontal portions 44*a* and the slant portions 44*b*. This position of the third lever shaft 35 will be hereinafter called "second shift position." When the operation lever 31 is in the third operational position shown in FIG. 7, the third lever shaft 35 is positioned at the upper ends of the slant portions 44*b* of the guide slots 44. This position of the third lever shaft 35 will be hereinafter called "third shift position." The distance between the third lever shaft 35 and the first lever shaft 32, and eventually a distance L (see FIG. 3) between the third engaging roller 35*a* and the first engaging roller 32*a* may vary in response to the movement of the third lever shaft 35 along the guide slots 44, which movement may be caused by the pivoting operation of the operation lever 31. Here, the distance L is used to mean a distance between the front end of the third engaging roller 35*a* and the rear end of the first engaging roller 32*a*.

As shown in FIGS. 3 and 5, the distance L has a maximum value when the third lever shaft 35 is in the first shift position (corresponding to the first operational position of the operation lever 31) and has a minimum value when the third lever shaft 35 is in the third shift position (corresponding to the third operational position P3 of the operation lever 31). When the operation lever 31 is in the second operational position, or when the third lever shaft 35 is in the second shift position, the distance L has a value that is smaller than the maximum value given at the first shift position but is larger than the minimum value given at the third shift position. Therefore, the distance L gradually decreases as the operation lever 31 pivots upward and rearward from the first operational position (see FIG. 5) to the third operation position (see FIG. 7) via the second operational position (see FIG. 6). Based on the change of the distance L between the third engaging roller 35*a* and the first engaging roller 32*a* by the pivoting operation of the operation lever 31, the top cover 40 can be mounted to or removed from the splitter 20 as will be described later.

The operation lever 31 has a first engaging portion 45 and a second engaging portion 46. As shown in FIGS. 3 and 5, when the operation lever 31 is in the first operational position, the first engaging portion 45 can prevent the cover shaft 56 of the side covers 55 from moving in a removing direction from the support slots 42. When the operation lever 31 is in the second operational position as shown in FIG. 6, the second engaging portion 46 can prevent the cover shaft 56 of the side covers 55 from moving in the removing direction from the support slots 42. Therefore, when the operation lever 31 is in either the first operational position or the second operational position, the side covers 55 can be held in a mounted state on the top cover 40. In other words, the side covers 55 can be locked against the top cover 40.

As the operation lever 31 is pivoted to the third operational position as shown in FIG. 7, the first and second engaging portions 45 and 46 move rearward (rightward as viewed in FIG. 7) away from the cover shaft 56. In other words, the first and second engaging portions 45 and 46 move to unlock positions. Therefore, the cover shaft 56 can move from the horizontal portions 42*b* to the vertical portions 42*a* of the support slots 42 and can move further so as to be removed from the support slots 42. As a result, it is possible to remove the side covers 55 from the top cover 40.

In connection with the mount device 30 constructed as described above, an opening 20*a* is formed in a cut-in manner in the upper portion of the splitter 20 (see FIG. 3). The opening 20*a* has a width L1 in the forward and rearward directions. A mount slot 20*b* is formed in continuity with the opening 20*a* and is positioned on the bottom side (lower side as viewed in FIG. 3) of the opening 20*a*. The mount slot 20*b* has a configuration elongated in the forward and rearward directions and has a width L2 in the forward and rearward directions. The width L2 is larger than the width L1 of the opening 20*a*.

The width L2 of the mount slot 20*b* is set to be substantially equal to the distance L between the third engaging roller 35*a* and the first engaging roller 32*a* when the third lever shaft 35 is in the first shift position. Therefore, by pivoting the operation lever 31 from the second or third operational position to the first operational position, the third engaging roller 35*a* can be pressed against the front edge of the mount slot 20*b* and the first engaging roller 32*a* can be pressed against the rear edge of the mount slot 20*b*. Hence, the engaging rollers 35*a* and 32*b* engage the mount slot 20*b*, so that the top cover 40 can be fixed in position relative to the splitter 20. In other words, the top cover 40 can be locked against the splitter 20.

By pivoting the operation lever 31 from the first operational position to the second operational position or the third operational position as shown in FIG. 6 or FIG. 7, the distance L between the third engaging roller 35*a* and the first engaging roller 32*a* becomes smaller than the width L1 of the opening 20*a*. Therefore, the engaging rollers 35*a* and 32*b* can move from the mount slot 20*b* into the opening 20*a* and can be then removed from the splitter 20. As a result, it is possible to remove the top cover 40 from the splitter 20.

As describe above, as the operation lever 31 pivots to the first operational position in the state where both of the third engaging roller 35*a* and the first engaging roller 32*a* are positioned within the mount slot 20*b* (i.e., in the state where the mount device 30 has been set to the splitter 20), the distance L between the engaging rollers 32*a* and 35*a* becomes maximum, so that the engaging rollers 32*a* and 35*a* are brought to engage the mount slot 20*b*. Therefore, the top cover 40 can be mounted to the splitter 20 (i.e., the state shown in FIG. 5). As the operation lever 31 pivots from the first operational position to the second operational position or the third operational position, the distance L between the first engaging roller 32*a* and the third engaging roller 35*a* become smaller, so that the engaging rollers 32*a* and 35*a* can be removed from the mount slot 20*b*. Thus, the top cover 40 can be removed from the splitter 20 (see FIG. 6 or FIG. 7).

As described previously, the movement of the cover shaft 56 is restricted or prevented by the first engaging portion 45 when the operation lever 31 is in the first operational position. The movement of the cover shaft 56 is restricted or prevented by the second engaging portion 46 when the operation lever 31 is in the second operational position. Therefore, when the operation lever 31 is in either the first operational position or the second operational position, the movement of the cover shaft 56 can be restricted or prevented, and therefore, the cover shaft 56 cannot be removed from the support slots 42. As a result, the side covers 55 can be fixed in the mounted position to the top cover 40. In other words, the side covers 55 can be locked against the top cover 40. Therefore, by positioning the operation lever 31 to the first operational position, both of the top cover 40 and the side covers 55 can be locked against the splitter 20.

On the other hand, when the operation lever 31 is in the second position, the second engaging portion 46 restricts or prevents the movement of the cover shaft 56, while the distance L between the first engaging roller 32*a* and the third engaging roller 35*a* is small to enable the removal of the engaging rollers 32*a* and 35*a* from the mount slot 20*b* and eventually from the opening 20*a*. As a result, it is possible to remove the top cover 40 and the side covers 55 together as an integrated assembly of the cover device 50.

Further, when the operation lever 31 is in the third operational position as shown in FIG. 7, the cover shaft 56 can be removed from the support slots 42, and the first and second engaging rollers 32*a* and 35*a* can be removed from the mount slot 20*b*. Therefore, the top cover 40 can be removed from the splitter 20, and the side covers 55 can be removed from the top cover 40. Thus, in this state, the top cover 40 and the side covers 55 can be removed from the splitter 20 independently of each other.

As described above, according to the cutting device 1 incorporating the mount device 30 of this embodiment, the side covers 55 can be removed from the splitter 20 by pivoting the operation lever 31 to the third operational position. Therefore, the replacement work of the saw blade 3 can be rapidly performed.

In addition, the top cover 40 and the side covers 55 can be removed as an integrated assembly of the cover device 50 from the splitter 20 by pivoting the operation lever 31 to the second operational position. Therefore, the replacement work of the saw blade 3 can be further rapidly performed. In addition, it is possible to rapidly prepare for an operation for forming a groove into a workpiece.

Further, the top cover 40 and the side covers 55 can be removed from the splitter 20 independently of each other by pivoting the operation lever 31 to the third operational position. Therefore, the necessary maintenance work for the mount device 30 can be rapidly performed.

Furthermore, by pivoting the operation lever 31 to the first operational position with the cover shaft 56 positioned within the horizontal portions 42*b* of the support slots 42, the top cover 40 can locked against the splitter 20 and the side covers 55 can be locked against the splitter 20 via the top cover 40. Therefore, the mount device 30 enables the top cover 40 and the side cover 55 to be locked against the splitter 20 by a single operation of the operation lever 31 and to be removed from the splitter 20 also by a single operation of the operation lever 31. As a result, it is possible to improve the operability in comparison with the arrangement where the top cover 40 and the side cover 55 are mounted to or removed from the splitter 20 by different operations from each other.

Because the kickback preventing claws 60 are supported on the top cover 40, the kickback preventing claws 60 can be mounted to and removed from the splitter 20 together with the top cover 40. Therefore, an operation for forming a groove into a workpiece and the necessary maintenance work can be further efficiently performed.

The mounting and removing operations described above can be performed by simply pivoting the operation lever 31 and do not require a special tool. Therefore, necessary operations can be easily and quickly performed.

The kickback preventing claws 60 can be held at a position extending along the lateral side portions 41 of the top cover 40 by pivoting the kickback preventing claws 60 upward and by positioning each kickback preventing claw 60 at the rest position. Therefore, it is possible to avoid potential interference of any other articles, such as hand tools, with the kickback preventing claws 60.

The above embodiment may be modified in various ways. For example, in the above embodiment, the top cover 40 can be removed from the splitter 20 and the side covers 55 can be removed from the top cover 40 when the operation lever 31 is in the third operational position. In other words, the top cover 40 and the side covers 55 can be removed independently of each other. However, it is possible to enable the situation where the side covers 55 can be removed from the top cover 40, while the top cover 40 is prevented from being removed from the splitter 20 when the operation lever 31 is in the third operational position. Thus, in this case, only the side covers 55 can be removed from the splitter 20 when in the third operational position. This situation can be enabled by changing the position of the second engaging portion 46 or by modifying the configurations of the guide slots 44 in order to change the path of movement of the actuation arm 34, which movement is caused by the pivotal movement of the operation lever 31. Also in this arrangement, the top cover 40 can be removed from the splitter 20 by returning the operation lever 31 to the second operational position after the side covers 55 have been removed from the top cover 40. Thus, both of the top cover 40 and the side covers 55 can be removed from the splitter 20.

Although the operation lever 31 has three different operational positions, it is possible to provide four or more different operational positions. For example, a fourth operational position may enable the situation where the kickback preventing claws can be removed from the top cover and eventually from the splitter.

This invention claims:

1. A cutting device comprising:

a table having an upper surface for placing a workpiece thereon;

a saw blade and a cover support each positioned relative to the table;

a first cover removably mounted to the cover support and constructed to cover the saw blade from a first side;

a second cover removably mounted to the first cover and constructed to cover the saw blade from a second side; and a single lock device operable in a first mode, a second mode and a third mode; wherein:

the first mode prevents the first cover from being removed from the cover support and prevents the second cover from being removed from the first cover;

the second mode permits the first cover to be removed from the cover support but prevents the second cover from being removed from the first cover;

the third mode permits the second cover to be removed from the first cover.

2. The cutting device as in claim 1, wherein the third mode permits the first cover to be removed from the cover support.

3. The cutting device as in claim 1, wherein the third mode prevents the first cover from being removed from the cover support.

4. The cutting device as in claim 1, wherein the lock device comprises:

a first lock device constructed to lock and unlock the first cover against the cover support;

a second lock device constructed to lock and unlock the second cover against the first cover; and an operation member coupled to the first lock device and the second lock device and operable by an operator.

5. The cutting device as in claim 4, wherein:

the operation member is movably mounted to the first cover and has a first operational position, a second operational position and a third operational position corresponding to the first mode, the second mode and the third mode, respectively;

the second position is an intermediate position between the first position and the third position; and the first and second lock devices are mounted to the operation member.

6. The cutting device as in claim 5 wherein:

the second lock device comprises a third engaging member and a fourth engaging member mounted to the operation member the third engaging member is positioned to prevent the second cover from being removed from the first cover when the operation member is in the second operational position; and the fourth engaging member is positioned to prevent the first cover from being removed from the first cover when the operation member is in the third operational position.

7. The cutting device as in claim 5 wherein each of the third and fourth engaging members is formed integrally with the operation member.

8. The cutting device as in claim 5, wherein the operation member is pivotally mounted to the first cover.

9. The cutting device as in claim 5, wherein:

the cover support comprises a splitter positioned in alignment with the saw blade in a cutting direction.

10. The cutting device as in claim 9, wherein:

the splitter comprises a mount slot having a width;

the first lock device comprises a first engaging member and a second engaging member connected to each other via a link mechanism, so that a distance between the first engaging member and the second engaging member can be changed between a first distance smaller than the width of the mount slot and a second distance substantially equal to or larger than the width of the mount slot.

11. The cutting device as in claim 10, wherein the first engaging member is fixed in position relative to the operation member, and the second engaging member is movably mounted to the first cover.

12. A cover device for covering a saw blade of a cutting device, comprising:

a cover support;

a first cover removably mounted to the cover support;

a second cover removably mounted to the first cover; and a lock device operable in a first mode, a second mode, and a third mode and comprising an operation member, so that the first mode, the second mode, and the third mode can be set by the operation of the operation member, wherein the first mode prevents the first cover from being removed from the cover support and prevents the second cover from being removed from the first cover;

the second mode permits the first cover to be removed from the cover support but prevents the second cover from being removed from the first cover;

the third mode permits the first cover to be removed from the cover support and permits the second cover to be removed from the first cover; and the lock device further comprises:

a first shaft vertically pivotally supporting the operation member relative to the first cover;

an actuation arm;

a second shaft vertically pivotally supporting one end of the actuation arm relative to the operation member;

a third shaft supported on the other end of the actuation arm, so that the third shaft can move to a first position, a second position and a third position as the operation member pivots about the first shaft to the first mode, the second mode and the third mode, respectively;

a first engaging device; and a second engaging device; wherein:

the first position is the furthest from the first shaft;

the third position is the closest to the first shaft;

the second position is positioned between the first position and the third position;

when the operation member is in the first mode, the third shaft is positioned at the first position, so that the first cover can be fixed in position relative to the cover support, and the second cover can be prevented from being removed from the first cover by the first engaging device;

when the operation member is in the second mode, the third shaft is positioned at the second position, so that the first cover can be removed from the cover support, and the second cover is prevented from being removed from the first cover by the second engaging device; and when the operation member is in the third mode, the third shaft is positioned at the third position, so that the second cover can be removed from the first cover.

13. A cutting device comprising:

a table having an upper surface for placing a workpiece thereon;

a saw blade protruding from the upper surface of the table;

a splitter disposed on a front side with respect to a cutting direction of the saw blade and positioned in alignment with the saw blade; and a cover device arranged and constructed to cover the saw blade, the cover device comprising:

a top cover for covering an upper side of the saw blade;

a pair of side covers for covering laterally opposite sides of the saw blade; and a mount device arranged and constructed to mount the top cover to the splitter and to mount the side covers to the top cover; wherein the mount device comprises a single an operation lever pivotally supported on the top cover and having at least three operational positions including a first operational position, a second operational position and a third operational position;

the top cover and the side covers can be mounted to the splitter when the operation lever is operated to move to the first operational position;

the top cover and the side covers can be removed together from the splitter when the operation lever is operated to move to the second operational position;

the side covers can be removed from the top cover when the operation lever is operated to move to the third operational position; and the mount device further comprises:

a first shaft vertically pivotally supporting the operation lever relative to the top cover;

an actuation arm;

a second shaft vertically pivotally supporting one end of the actuation arm relative to the operation lever;

a third shaft supported on the other end of the actuation arm, so that the third shaft can move to a first position, a second position and a third position as the operation lever pivots about the first shaft to the first operational position, the second operational position and the third operational position, respectively;

a first engaging device; and a second engaging device; wherein:

the first position is the furthest from the first shaft;

the third position is the closest to the first shaft;

the second position is positioned between the first position and the third position;

when the operation lever is in the first operational position, the third shaft is positioned at the first position, so that the top cover can be fixed in position relative to the splitter, and the side covers can be prevented from being removed from the top cover by the first engaging device;

when the operation lever is in the second operational position, the third shaft is positioned at the second position, so that the top cover can be removed from the splitter, and the side covers are prevented from being removed from the top cover by the second engaging device; and when the operation lever is in the third operational position, the third shaft is positioned at the third position, so that the side covers can be removed from the top cover.

14. The cutting device as in claim 13 wherein:

the splitter has an opening and a mount slot formed in continuity with the opening;

the opening is formed in a cut-in manner in an upper portion of the splitter and has a first width;

the mount slot has an elongated configuration and has a second width larger than the first width of the opening;

when the operation lever is in the first operational position, the first shaft and the third shaft can engage opposite edges in forward and rearward directions of the mount slot, so that the first shaft and the third shaft can be prevented from moving though the opening to thereby enable to mount the top cover to the splitter; and when the operation lever is in the second operational position, the first shaft and the third shaft can move through the opening to thereby enable to remove the top cover from the splitter.

* * * * *